United States Patent [19]

Cozzens et al.

[11] Patent Number: 4,645,285

[45] Date of Patent: Feb. 24, 1987

[54] SEALED INSULATION DISPLACEMENT CONNECTOR

[75] Inventors: Brian E. Cozzens, Mechanicsburg; John R. Hopkins, Hummelstown; Anil C. Thakrar, Camp Hill, all of Pa.

[73] Assignee: AMP Incorporated, Harrisburg, Pa.

[21] Appl. No.: 769,294

[22] Filed: Aug. 26, 1985

[51] Int. Cl.[4] ..... H01R 4/24; H01R 13/52

[52] U.S. Cl. ..... 339/96; 339/97 P

[58] Field of Search ..... 339/97 R, 59 R, 59 M, 339/60 R, 60 M, 96, 97 P, 98, 99 R

[56] References Cited

U.S. PATENT DOCUMENTS

| | | | |
|---|---|---|---|
| 3,380,014 | 4/1968 | Schenker et al. | 339/97 R |
| 3,770,874 | 11/1973 | Krieger et al. | 339/275 B |
| 3,905,665 | 9/1975 | Lynch et al. | 339/275 B |
| 3,923,362 | 12/1975 | Dunn et al. | 339/99 R |
| 4,296,988 | 10/1981 | Warner | 339/97 R |
| 4,326,767 | 4/1982 | Silbernagel et al. | 339/98 |
| 4,385,794 | 5/1983 | Lucius | 339/97 R |
| 4,444,447 | 4/1984 | Markwardt | 339/97 R |

FOREIGN PATENT DOCUMENTS

| | | | |
|---|---|---|---|
| 1640482 | 7/1977 | Fed. Rep. of Germany | 339/96 |
| 2912882 | 10/1980 | Fed. Rep. of Germany | 339/99 R |
| 3,108,931 | 11/1982 | Fed. Rep. of Germany | 339/97 R |
| 2058485 | 4/1981 | United Kingdom | 339/97 P |

*Primary Examiner*—Gil Weidenfeld
*Assistant Examiner*—Gary F. Paumen
*Attorney, Agent, or Firm*—Adrian J. LaRue; Frederick W. Raring

[57] ABSTRACT

A sealed insulation displacement connector comprises a first housing member in which is located an electrical terminal having a slotted insulation displacement section, and a second housing member in which an elastomeric body of sufficient rigidity is disposed so that when an insulated conductor is aligned with the slotted insulation displacement section the housing members are moved relative to each other causing the elastomeric body to forcefully move the insulated conductor into the slotted insulation displacement section thereby terminating the conductor with the elastomeric body sealingly engaging the connection formed between the conductor and the electrical terminal.

6 Claims, 6 Drawing Figures

SEALED INSULATION DISPLACEMENT CONNECTOR

BACKGROUND OF THE INVENTION

1. Field of the Invention

This invention relates to a Sealed Insulation Displacement Connector (IDC) and, more specifically, to an IDC connector wherein the connection between an insulated conductor and electrical terminal is surrounded by an elastomeric material such as a closed cell foam dielectric insulation.

2. Description of the Prior Art

IDC connectors have been known for many years, typical connectors of this type being set forth in U.S. Pat. No. 3,820,055 to Huffnagle et al which is exemplary of such prior art. In IDC connectors of this type, one or more metal terminals having slotted beams is secured in an insulating housing which generally has a top and bottom portion arranged to be closed to force the insulated conductors within the slots of the beams. Such conductors are then terminated as the edges of the beams pierce through the insulation and springably engage the conductors. Devices of this type are widely used in many applications throughout industry. Years of experience, however, have shown that the quality of connection can deteriorate due to cable strains, vibration, thermal cycling due to variations in surrounding atmosphere and, from time to time, due to airborne impurities carried in the environment of use. These problems have become more evident as the IDC connections have been employed in more and different uses than originally intended. For example, in uses for interconnecting telephone cable, which is more exposed to the elements, the foregoing problems have been countered by the use of grease which tends to seal the interconnection area. The patent of Freudenberg U.S. Pat. No. 3,410,950 shows such use, relative to an IDC connection. The problem with grease is that it may flow solid in extreme cold, that termination is made difficult. Additionally, grease does not provide structural support or strain relief to the interconnected insulated conductor. In fact, grease is messy in use and difficult to apply in assembly and production.

Finally, the present invention answers a growing need for electrical devices that non-technicians can use to interconnect computer and telecommunication networks and devices.

BRIEF DESCRIPTION OF THE INVENTION

In accordance with the present invention, the above noted problems are substantially minimized and an additional advantage is provided to an IDC type connector through the use of an elastromeric body capable of not only sealing the connection of terminal and insulated conductor, but providing a pushing force to drive the conductor into the slotted beam of the terminal to form the connection in such a way that improved strain relief and vibration dampening is assured. A two-piece housing is utilized containing the IDC electrical terminals with one of the connector housing portions containing an elastomeric body in the form of closed cell foam. This foam is sufficiently rigid to push the conductor into the slotted IDC beams to make an electrical connection and yet sufficiently pliable to seal the interconnection, provide strain relief, vibration dampening and eliminate contaminates due to temperature variations in the surrounding environment. In use the insulated conductor is inserted into the connector which is then actuated to cause the IDC terminal beams to penetrate into the foam as the termination is made. This reduces the free space contained within the connector to an absolute minimum and supports the conductor intimately fore and aft of the actual interconnection area. The elastomer or foam must be stiff enough or rigid enough to push the cable wire into the IDC terminal slot far enough to effect a solid termination, and yet sufficiently elastic so that the foam will compress and displace to effectively seal the interconnection. The hardness or the elasticity of the foam must accordingly be adjusted, relative to the pressure required to push the wire into the IDC slot and effect the desired seal. Foam characteristics will vary in accordance with the design of the connector halves, the dimensions and sharpness of the IDC terminal, wire gage and conductor insulation and other parameters of the parts.

DESCRIPTION OF THE PREFERRED EMBODIMENTS

Figure 1:
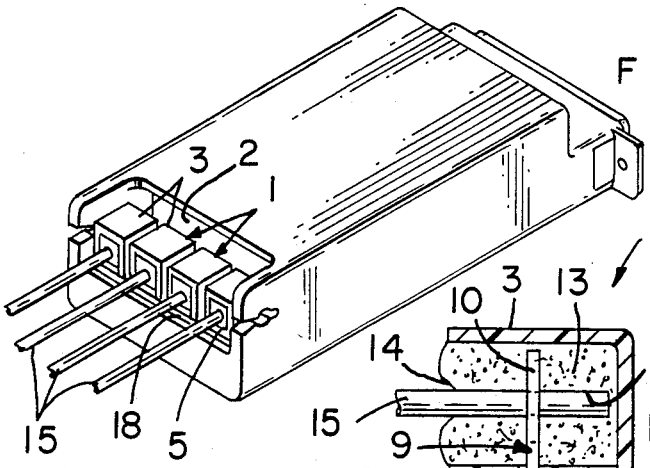
FIG. 1 is a perspective view of a terminated connector in accordance with the present invention.
Figure 2:
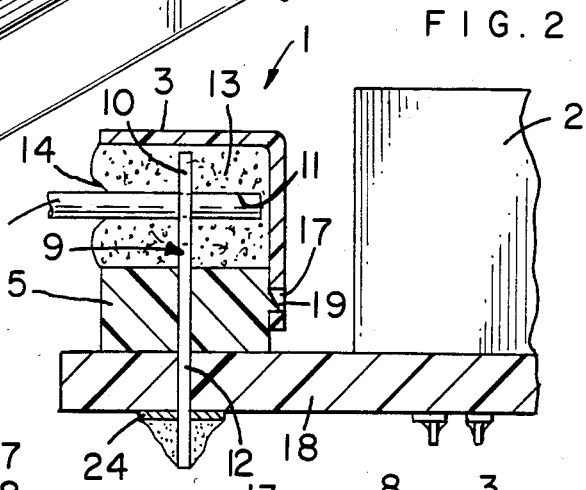
FIG. 2 is a cross-sectional view of the connector terminated, the connector being mounted on a printed circuit board containing an electronic component.

Referring to FIG. 1, the present invention is shown wherein four insulated conductors 15 which are typically ground and signal transmission pairs to and from some centralized computer or communication unit are terminated to connectors which are connected to a printed circuit board 18 and thus to an electronic package 2 such as a modem or multiplexer. The connector shown in FIGS. 1 and 2 is comprised of an assembly including connector cap portions 3, one for each conductor 15 and base portions 5 which serve as a base or connectors 1. Cap portions 3 and base portions 5 are molded from a suitable material having the desirable dielectric characteristics.

Figure 3:
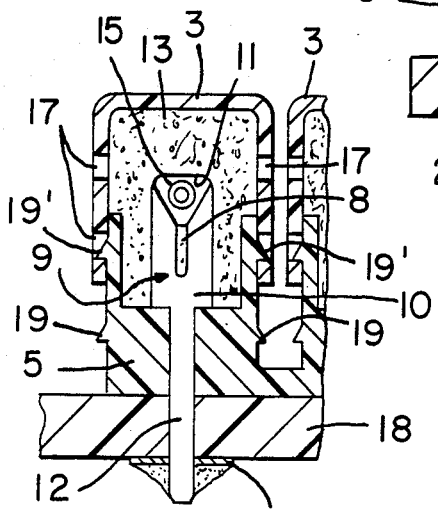
FIG. 3 is elevational and sectional view of the connector shown in FIG. 2 in an unterminated position.
Figure 4:
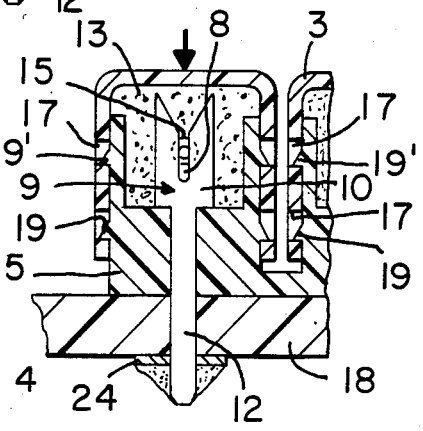
FIG. 4 is a view similar to FIG. 3 showing the connector in an actuated condition terminating the conductor.

Cap portions 3 are displaceable to effect termination of the conductors from an upward position as shown in FIG. 3 to a downward position as shown in FIGS. 2 and 4. The cap portions 3 contain an elastomeric body or closed cell foam 13 which is formed into the interior of the cap portions as by molding or casting and includes a conductor-guiding aperture 11 having a funnel entry 14 to assist in insertion of insulated conductor 15 therewithin. The cap portions 3 include apertures 17 in which projections 19 on base portions 5 are disposed to latch cap portions 3 downwardly upon termination as shown in FIGS. 2 and 4. Projections 19' are also provided on base portions 5 above projections 19 for disposition within apertures 17 to maintain cap portions 3 in non-terminated positions as shown in FIG. 3.

Mounted within base portions 5 are electrical terminals 9 of the IDC type having upper portions 10 containing slots 8 to effect insulation displacement and termination with insulated conductors and lower tab portions 12, as shown, which extend through holes in the printed circuit board 18 to be soldered to conductive paths 24 thereon shown in FIGS. 2–4. Slots 8 at their outer ends are tapered thereby acting as a guide for guiding the conductors into slots 8.

In application the connectors 1, in pre-assembled form with cap portions 3 in the upward position, are placed upon the PC Board 18 and flow soldered at the same time that the electronic component 2 is soldered thereto. The connectors 1 are shipped to the site of use in such condition and held thereat by virtue of projections 19' disposed within apertures 17.

In use, insulated conductors are inserted into apertures 11 via funnel entries 14 into cap portions with cap portions 3 then being pushed down much as one would push a button. Conductors 15 are thus forced within slots 8 of terminals 9 via material 13 with the foam and/or elastomer material 13 completely surrounding the conductors 15, the upper portions 10 of terminals 9 thereby sealingly enclosing the interconnection between upper portions 10 of terminals 9 and conductors 15 as shown in FIGS. 2 and 4. Material 13 thus supports the conductors 15 from an entry point to the termination point against vibration, bending or twisting loads, and it effectively seals the interconnection from the outside environment. The assembly shown in FIGS. 1–4 is intended for a one time use with the latching structure comprised of apertures 17 and projections 19 effectively latching the cap portions 3 down upon base portions 5. In U.S. patent application Ser. No. 453,309 filed Dec. 27, 1982, now abandoned, an assembly of cap, base and IDC termination is disclosed which allows for reuse of the connector by providing means to withdraw the cap upwardly and yet prevent the cap from removal from the base of the unit. The disclosure in this early filed application is incorporated herein by reference and utilized to teach one skilled in the art of a version wherein the caps of the earlier application can be filled with an elastomer or foam to accomplish the intended result of the present invention.

As will be noted in FIG. 1, it is contemplated that the cap portions 3, which are push-button like, may be suitable numbered and colored in the color code matching the code of the four conductors so that non-technicians may readily interconnect electronic components such as 2 into networks for premise wiring in offices, buildings, factories and the like. The arrangement of the cap portions 3 and base portions 5 along with the following feature of the apertures 11 in material 13, tends to make connectors 1 foolproof in that an operator inserts the conductors 15 into apertures 11 until they no longer can be inserted therein and then the cap portions are pushed down without particular skills.

In general use, individual conductors 15, may be expected to be on the order of between 18 and 28 AWG covered with PVC or polyropylene or polyethylene or the equivalent insulation. These conductors may be stranded or solid wire, most of the larger gage wires being stranded and most being tin plated. In general, the width of slots 8 of IDC terminals 9 apart from the tapered entries, should be on the order of 40% to 80% of the diameter of the conductors to be terminated thereto. For example, in a solid wire conductor of 20 AWG, having a diameter of 0.032 inches, optimum slot dimensions would be on the order of between 0.0160 and 0.020 inches. For a number 28 AWG solid wire conductor having a diameter of 0.0126 inches, slot dimension would be in the range of 0.0075 and 0.010 inches. Terminal constructions may be of brass, phosphous bronze, suitably stamped and formed, of a thickness and width and general construction to assure integrity in termination of the conductors and penetration of the terminals into the elastomer or foam material. In one example, the terminals were made of phosphous bronze, half hard, and tin plated of a stock 0.013 inches thick and shaped as shown in the drawings herein. The force to terminate the conductors by a downward movement of cap portions 3 was on the order of between 12 and 15 pounds, readily done by manual depression.

Elastomeric bodies were utilized including foam, polyether urethanes (non-reticulated), polyester urethanes (non-reticulated both having densities in the range of 8 to 23 PCF with tensile values in the range of 100 to 400 PSI and having stiffness in the range of 50 to 70 (A scale Shore). The former foam is good for high temperature, high humidity applications (up to 250° F. and 95% humidity), the latter being good in dry heat.

Figure 5:
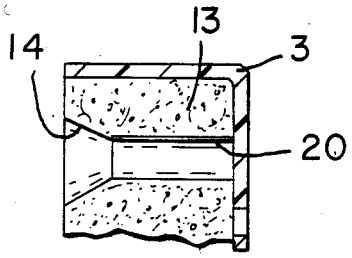
FIG. 5 shows a cross-section of a hybrid construction for elastomeric elements utilizing a film embedded therein.
Figure 6:
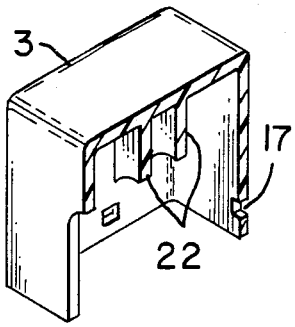
FIG. 6 is a cutaway perspective view of the cap showing pusher members.

In certain applications, the need for sealing at the environment of use may demand an elasticity too soft to provide adequate structure. FIG. 5 shows a variation of the invention wherein a film of material 20 is sandwiched within the foam elastomer 13 within cap portion 3. The film may be of a thermoset polyester like Mylar (trademark of E. I. Dupont DeNeumors Company Inc.) on the order of 0.001–0.002 inches thick, thin enough to permit penetration by terminals 9 but adding structure to push conductors 15 adequately. Alternatively, pusher members 22 can be part of cap portions 3 to push conductors 15 into the slots of the terminals instead of using material 20, as shown in FIG. 6.

It can be seen from the above description that an insulation displacement connector is disclosed wherein the connection is insulated and sealed both from the environment as well as from thermal cycling to minimize problems caused by these undesirable conditions.

Though the invention has been described with respect to specific preferred embodiments thereof, many variations and modifications will immediately become apparent to those skilled in the art. It is, therefore, the intention that the appended claims be interpreted as broadly as possible in view of the prior art to include all such variations and modifications.

We claim:

1. An electrical connector for providing a sealed electrical connection of a conductor wire to a further conductor path, said connector including first and second insulating housing members, a terminal carried by said first member having on an upper portion thereof a sharply-pointed end adapted for stabbing into an elastomer, leading from said upper end a funnel-shaped adapter to guide a conductor wire into said terminal, a centrally disposed slot within said terminal adapted to receive said wire as the wire is pushed therein and guided by said funnel shape for termination to said terminal, the said second housing member having a cap configuration dimensioned to fit over said first member in telescoping relationship thereto, said second member having an exterior top surface adapted to be manually depressed, an insulating elastomer fitted within said cap substantially filling said cap and including a bore extending therethrough adapted to receive said wire inserted therein, the said second member further including an aperture lined up with said bore and having an internal dimension to initially position said second member relative to said first member to guide a wire into said bore just above said funnel shape of said terminal, whereby upon force applied to the top of said second member, said second member is displaced relative to said first member to cause said sharply-pointed end of said terminal to stab into and slidingly engage said elastomer with a wire inserted in said bore being carried within and into connection with said slot and with the said elastomer being compressed within said second member to seal the resulting connection.

2. The connector of claim 1 wherein there is included as part of the said second member a further plastic element internally positioned to push said wire into said slot.

3. The connector of claim 2 wherein said further plastic element is comprised of a projection integral with the material of said second member.

4. The connector of claim 2 wherein said further plastic element is an insulating film.

5. The connector of claim 1 wherein said elastomer has a density and said terminal is of a cross-sectional geometry including said sharply-pointed end and said slot has a width relative to said wire to provide an engagement for termination on the order of 20 pounds or less, thus characterizing the connector for manual depression and operation by hand.

6. An electrical connector of the toolless type adapted for manual operation including an insulating base member and an insulating cap member, the external dimension of the base member and the internal dimension of the cap member being adapted to allow telescoping relationship with said cap slidingly mounted on said base member, sharply-pointed electrical terminal having a slot therein dimensioned to receive a conductor wire forced into said slot for termination thereto, said cap member being essentially filled with an insulating elastomer of a density and rigidity to allow said terminal to stab therein in a cutting and sliding relationship when the elastomer is compressed within said cap member, the said cap and said elastomer having a bore adapted to receive a conductor wire inserted therein directly over said terminal and the said cap having an exterior top portion adapted to accommodate manual pushing, whereby the said cap can be depressed to cause said terminal to stab into said elastomer and said wire is terminated within said slot and the termination sealed by the compression of said elastomer.

* * * * *